US010913571B2

(12) United States Patent
Kuhmann et al.

(10) Patent No.: US 10,913,571 B2
(45) Date of Patent: Feb. 9, 2021

(54) PALLET HAVING PANELS AND TUBE SEGMENTS

(71) Applicant: AIR BAMBOO INDUSTRIAL GMBH, Eberswalde (DE)

(72) Inventors: Jochen Kuhmann, Berlin (DE); Matthias Albrecht, Berlin (DE); Roman Kujus-Tenekedshijew, Federow (DE)

(73) Assignee: AIR BAMBOO INDUSTRIAL GMBH, Eberswalde (DE)

( * ) Notice: Subject to any disclaimer, the term of this patent is extended or adjusted under 35 U.S.C. 154(b) by 0 days.

(21) Appl. No.: 16/480,680

(22) PCT Filed: Jan. 22, 2018

(86) PCT No.: PCT/EP2018/051468
§ 371 (c)(1),
(2) Date: Jul. 25, 2019

(87) PCT Pub. No.: WO2018/138057
PCT Pub. Date: Aug. 2, 2018

(65) Prior Publication Data

US 2019/0382159 A1 Dec. 19, 2019

(30) Foreign Application Priority Data

Jan. 25, 2017 (EP) ..... 17153149

(51) Int. Cl.
*B65D 19/00* (2006.01)

(52) U.S. Cl.
CPC ..... *B65D 19/0075* (2013.01); *B65D 2519/00029* (2013.01); *B65D 2519/00064* (2013.01); *B65D 2519/0094* (2013.01); *B65D 2519/00273* (2013.01); *B65D 2519/00293* (2013.01); *B65D 2519/00303* (2013.01); *B65D 2519/00323* (2013.01); *B65D 2519/00338* (2013.01);

(Continued)

(58) Field of Classification Search
CPC ..... B65D 19/0012; B65D 19/0006; B65D 19/0075
USPC ..... 108/57.29
See application file for complete search history.

(56) References Cited

U.S. PATENT DOCUMENTS 3,434,435 A * 3/1969 Achermann ..... B65D 19/0028 108/51.3
5,535,668 A * 7/1996 Besaw ..... B65D 19/0012 108/51.3

(Continued)

*Primary Examiner* — Daniel J Rohrhoff
(74) *Attorney, Agent, or Firm* — JMB Davis Ben-David

(57) ABSTRACT

The invention relates to a pallet (1) comprising parallel panels (11, 12), a layer (13) arranged between the panels (11, 12) and formed by at least one spacer (18), having a respective first strip (15*a*) and a plurality of tube segments (14), wherein the tube segments (14) have two respective cut ends (141, 142) and two respective cut surfaces (143, 144), wherein the tube segments (14) are mechanically connected to the first strip (15*a*) by their cut ends (141, 142), and mechanically connected to the panels (11, 12) by their cut surfaces (143, 144), wherein the tube segments (14) of the at least one spacer (18) have two respective lateral elements (146) and a cover element (147) mechanically connected to the lateral elements (146), wherein the lateral elements (146) form a first internal angle (α) of 95° to 120° with the cover element (147).

19 Claims, 5 Drawing Sheets

(52) U.S. Cl.
CPC ..... *B65D 2519/00437* (2013.01); *B65D 2519/00562* (2013.01)

(56) References Cited

U.S. PATENT DOCUMENTS

| | | | | | |
|---|---|---|---|---|---|
| 5,660,119 | A * | 8/1997 | Perkins | ..... | B65D 19/0012 108/51.3 |
| 5,672,412 | A * | 9/1997 | Phares | ..... | B32B 3/28 428/182 |
| 6,135,030 | A * | 10/2000 | Besaw | ..... | B65D 19/0012 108/51.3 |
| 2008/0053342 | A1 * | 3/2008 | Muirhead | ..... | B65D 19/0018 108/57.25 |
| 2019/0375544 | A1 * | 12/2019 | Kuhmann | ..... | B65D 19/0075 |

* cited by examiner

PALLET HAVING PANELS AND TUBE SEGMENTS

CROSS-REFERENCE TO RELATED APPLICATIONS

This is the U.S. National Stage of International Patent Application No. PCT/EP2018/051468 filed Jan. 22, 2018, which claims priority to European Patent Application No. 17153149.4 filed Jan. 25, 2017.

The invention relates to a pallet, in particular for the transport of goods.

Transport pallets according to EN 13698-1 and UIC 435-2 (Europool pallets) are known from the state of the art. These have three bottom boards, each connected by three blocks to three transverse boards on which five top boards are arranged. The corresponding boards are made of solid wood.

A disadvantage of solid wood pallets is their relatively high weight (20 to 24 kg, depending on wood moisture content, with dimensions of 1200×800×144 mm).

This results in the task of providing a pallet which, compared to the state of the art, has a reduced weight with sufficient stability.

This task is solved by the pallet of the present invention according to claim 1. Specific embodiments of the pallet are specified in sub claims 2 to 15. The embodiments are described below.

A first aspect of the invention concerns a pallet comprising at least the following components:

a first panel and a second panel parallel to the first panel;

a layer disposed between the first panel and the second panel from at least one spacer extending along a first longitudinal direction, each spacer comprising a first strip and a plurality of tube segments;

wherein the tube segments each comprise two cut ends delimiting the respective tube segment along a circumferential direction of the respective tube segment, and each comprise two cut surfaces which delimit the respective tube segment along a second longitudinal direction of the respective tube segment, wherein the tube segments have a segment width running along the connecting line between the cut ends, and wherein the tube segments are mechanically connected to the first strip by their cut ends and mechanically connected to the first panel and the second panel by their cut surfaces, wherein the tube segments of the at least one spacer each have two lateral elements and a cover element mechanically connected to the lateral elements, wherein the lateral elements form first internal angles (a) of 95° to 120° with the cover element.

The at least one spacer of the layer extends in the first longitudinal direction. This first longitudinal direction refers to the direction along which the first strip runs. Thus the second longitudinal direction of the tube segments runs in particular perpendicular to the first longitudinal direction.

According to a further embodiment, the tube segments are arranged perpendicular to the first panel and the second panel in relation to their longitudinal direction. This results in a particularly good mechanical stability of the layer.

According to one embodiment, the layer of the pallet comprises a plurality of spacers, whereby the spacers in particular are arranged parallel to each other in relation to the first longitudinal direction.

The pallet has in particular a pallet width and a pallet depth, the pallet width extending along the first longitudinal direction and the pallet depth extending transversely to the pallet width in the extension plane of the first and second panels.

In the context of this invention, the term tube segment refers to a part of a real or imaginary tube with the first longitudinal direction. The cross-section of the tube perpendicular to the first longitudinal direction has a circumference, i.e. an imaginary line, which delimits the cross-section on its outside. The cross-section does not have to be circular or elliptical, but can also be angular, e.g. trapezoidal segment shaped. The circumferential direction of the tube runs (also in the case of a tube with an angular cross-section) along an imaginary circle which surrounds the cross-section of the tube perpendicular to the longitudinal direction.

The tube segments each comprise a wall which is delimited in the circumferential direction by the cut ends, wherein the wall is open in the circumferential direction. The wall is continuously open in the longitudinal direction. The circumferential direction of the tube segment refers to the circumferential direction of the associated real or imaginary tube, which has a closed wall. The tube segment can be formed in particular by cutting the tube, but can also be formed in another way, in particular by mechanically connecting several strips.

The cut ends of the tube segment delimit the tube segment in the circumferential direction. The wall of the tube segment is thus limited in the circumferential direction by the cut ends. The cross-section of the tube segment is thus formed by an open profile.

The tube segments further comprise two cut surfaces, which delimit the tube segments in the longitudinal direction. The cut surfaces particularly extend perpendicular to the longitudinal direction.

The segment width of the tube segments extends along the connecting line between the cut ends. This connecting line between the cut ends particularly extends along the common direction of the cut surfaces. In cases where the cut surfaces are not parallel to each other in cross-section, the connecting line is defined between the points of the cut surfaces with the greatest extent in circumferential direction.

The tube segments each form a cavity within the layer of spacers bounded by the inner surface of the wall. Therein, the segment width (i.e. the outer width of the tube segment) corresponds to the sum of the maximum extension of the cavity in the direction of the connecting line between the cut ends perpendicular to the longitudinal direction (i.e. in cross-section) and twice the wall thickness. The segment height corresponds to the sum of the maximum extension of the cavity perpendicular to the segment width and the wall thickness.

Furthermore, the tube segments have a segment depth extending along the second longitudinal direction and the tube segments have a segment height extending perpendicular to the direction of the segment width and the direction of the segment height.

According to a further embodiment, all tube segments of the at least one spacer essentially have a uniform segment depth. According to another embodiment, all tube segments of the at least one spacer essentially have a uniform segment width. According to another embodiment, all tube segments of at least one spacer essentially have a uniform segment height.

The tube segments are each connected to the first strip by means of both cut ends. In the pallet, in particular, each tube segment is connected with one of its cut surfaces to the first panel and with the other cut surface to the second panel.

In accordance with the invention, the tube segments of the at least one spacer each comprise two lateral elements and a cover element mechanically connected to the lateral elements, wherein the lateral elements form first internal angles ($\alpha$) of 95° to 120° with the cover element.

This means that the longitudinal directions of the lateral elements each run at an obtuse angle to the longitudinal direction of the cover element. This can result, for example, in a trapezoidal segment shaped profile. If the cover element runs parallel to the first strip of the spacer to which the respective tube segment is mechanically connected, a corresponding third internal angle of $\gamma=180°-\alpha$, i.e. in the range from 60° to 85°, results between the respective lateral element and the first strip.

Such tube segments consisting of only three components are easy to construct, but nevertheless allow a high mechanical stability of the pallet with low weight.

The special profile shape of the tube segments according to the invention with first internal angles in the range of 95° to 120° results in a particularly good mechanical load capacity of the tube segments in the direction of the segment height (i.e. perpendicular to the second longitudinal direction of the tube segments and perpendicular to a connecting line between the cut ends, also termed segment width), in particular perpendicular to the longitudinal direction of the cover element.

For example, such tube segments can withstand a force acting on the tube segments along the segment height better than flatter profiles (i.e. those with larger first internal angles). Such forces occur in particular when pressing the tube segments with strips during the production of the spacers or when pressing longer tube segments with cover layers during the production of intermediate products for the production of spacers and can lead to deformation or breaking of the tube segments. Thus the profile shape according to this invention results in a cost-relevant reduction of scrap during production.

Compared to rectangular-segment-shaped profiles (first internal angle=90°), tube segments in the sense of the present invention have the advantage that the tube segments cover a larger area of the respective spacer along the first longitudinal direction of the spacers, so that fewer tube segments per spacer are required to stiffen the pallet. This advantageously reduces the weight of the pallet and saves material costs.

According to another embodiment, the tube segments are each formed from two lateral elements and a cover element.

According to another embodiment, the cover elements of the at least one spacer run parallel to the respective first strip of the at least one spacer to which the tube segments are mechanically connected.

According to another embodiment, the lateral elements of the tube segments of the at least one spacer form third internal angles of 60° to 85° with the first strip of the at least one spacer to which the tube segments are mechanically connected.

According to another embodiment, both lateral elements form the same first internal angle with the cover element.

According to another embodiment, the first internal angles ($\alpha$) are 100° to 110°.

This area is particularly advantageous in terms of good mechanical load-bearing capacity in the direction of the segment height in combination with good covering of the spacer in the direction of the segment width.

According to a further embodiment, the tube segments comprise first mitres on which the lateral elements are mechanically connected to the cover element.

The lateral elements and the cover element can be easily produced from a panel or board by introducing mitres, folding on the mitres and mechanical joining (e.g. gluing). The first internal angles between the lateral elements and the cover element, in particular, can be set at any angle between 95° and 120° by means of an appropriate mitre design.

According to a further embodiment, the lateral elements and the cover element are each made of a strip, in particular of a wood-based material.

According to a further embodiment, the tube segments have a trapezoidal segment shaped cross-section in relation to the second longitudinal direction of the tube segments (in particular transverse to the plane of the first and second panels). This is the case with the specified first internal angles if the cover element runs parallel to the first strip of the respective spacer and has the advantage, in addition to the mechanical load-bearing capacity and covering of the spacers, that the spacers can be arranged parallel within the layer without gaps.

According to another embodiment, the tube segments of at least one spacer are mechanically connected to a first strip side of the first strip. This means that all tube segments are arranged next to each other on one side of the strip.

According to a further embodiment, the at least one spacer comprises a second strip, which is mechanically connected to the walls of the tube segments of the respective spacer. In particular, the second strip runs parallel to the first strip. The second strip particularly increases the mechanical stability of the spacers. In addition, in the case of an embodiment of the layer in which adjacent spacers are close together, the second strip may be in contact with the first strip of an adjacent spacer to form a continuous structure, which further increases the stability of the pallet.

According to an embodiment, the pallet comprises a wood-based material, wherein particularly the pallet is made of a wood-based material.

According to another embodiment, the first panel and/or the second panel comprises a wood-based material, wherein particularly the first panel and/or the second panel is made of a wood-based material.

According to an embodiment, the at least one spacer comprises a wood-based material, wherein particularly the at least one spacer is formed from a wood-based material.

According to a further embodiment, the tube segments comprise a wood-based material, wherein particularly the tube segments are formed from a wood-based material.

According to a further embodiment, the first strip and/or the second strip comprises a wood-based material, wherein particularly the first strip and/or the second strip is formed from a wood-based material.

In the context of the present invention, the term wood-based material refers to a material which comprises comminuted wood, in particular wood chips, wood chips, wood veneers, wood veneer strips, wood wool, wood fibres or wood dusts, or other lignocellulose materials. Furthermore, the wood-based material may in particular contain binders, adhesives and/or additives. Additives can in particular be hydrophobizing agents, wood preservatives, flame retardants, hardeners or paint particles. Binders include in particular urea glue, synthetic resins, e.g. phenolic resins, isocyanates, plastics and/or bioplastics. Wood veneers and/or wood veneer strips are used in particular for the production of plywood and/or coarse particle boards (OSB boards).

Wood-based materials include in particular solid wood-based materials, e.g. solid wood panels (in accordance with DIN EN 12775) or laminated wood panels, cross laminated timber, glued laminated timber, plywood and/or laminated timber, veneer wood-based materials, e.g. veneer plywood (FU), veneer laminated wood, veneer strip wood, bending plywood, wood-chip materials, e.g. flat pressed boards (P2), extruded boards, chipboard shaped parts, coarse chipboard (OSB boards, according to DIN EN 300) and/or chipboard strip wood (LSL), wood fibre materials, e.g. wood fibre insulating boards (HFD), porous fibre boards, soft boards (SB), medium hard fibre boards (MB), hard fibre boards (HB or HFH), hard fibre boards, extra hard fibre boards (HFE), medium density fibre boards (MDF), high density fibre boards (HDF) and/or ultra light fibre boards (ULDF), Arboform or liquid wood.

The term fibreboard refers to the wood-based materials specified in DIN EN 622. The term chipboard refers to the wood-based materials specified in the standards DIN EN 309 and DIN EN 312. The term plywood refers to the wood-based materials specified in the standards DIN 68708 and DIN EN 313.

As a basic material for carcass and interior construction, wood-based materials have the advantage of high material strength and mechanical load-bearing capacity while being lightweight at the same time.

According to one embodiment, the wood-based material has a lignin content of >5%, in particular >10% by weight. This means that in particular paper and cardboard do not represent wood-based materials in the sense of the present invention, since the lignin of the wood raw materials used is largely removed during paper production, e.g. by chemical bleaching agents.

According to another embodiment, the wood-based material is free of chemical bleaching agents.

According to another embodiment, the wood-based material is produced in a dry process with a wood moisture content of <20%. The percentage refers to the ratio of the water weight to the absolutely dry wood mass. In a dry process, the wood particles are dried to the product before the fleece formation and the pressing and the product shows a wood moisture of under 20%. The glue can be applied before or after drying.

According to another embodiment, the wood-based material comprises wood fibres pressed under pressure and/or heat. According to a further embodiment, the wood-based material has a density of >800 kg/m$^3$. High-density fibreboards, for example, have a density in this range.

According to another embodiment, the wood-based panel is the material of a high-density fibreboard (HDF).

According to another embodiment, the tube segments are formed from a plurality of strips. The strips run in the longitudinal direction of the tube segment. In this embodiment, in particular a tube segment with an angular cross-section is formed.

According to a further embodiment, the tube segments of the at least one spacer are spaced apart, wherein the at least one spacer comprises first gaps between adjacent tube segments of the at least one spacer, and wherein the first panel comprises at least one first opening at least partially overlapping one of the first gaps. This means that the spacer comprises gaps between all adjacent tube segments.

Alternatively, the at least one spacer can also be constructed without first gaps, i.e. in particular with tube segments close to each other.

According to a further embodiment, the first panel comprises a plurality of first openings, each of the first openings overlapping at least partially with a respective first gap of a respective spacer of the layer.

Due to the first gaps of the spacers, such a pallet has a very low weight and high mechanical stability at the same time. In addition, the overlapping arrangement of the first openings with the first gaps allows additional components, e.g. feet of the pallet, to be easily inserted into the first openings and connected to the pallet, e.g. attached to the pallet.

The at least one first opening of the first panel particularly comprises an extension along the first longitudinal direction (i.e. along the pallet width) and an extension transverse to the first longitudinal direction in the plane of the first and second panel (i.e. along the pallet depth).

According to an embodiment, the at least one first opening has a rectangular shape.

In particular, each spacer comprises at least three tube segments. This results in at least two first gaps between the adjacent tube segments of the corresponding spacer.

According to an embodiment, the tube segments have a segment width running along the connecting line between the cut ends, wherein the adjacent tube segments (i.e. all respectively adjacent tube segments) of the at least one spacer have a first distance of at least half a segment width, in particular at least one segment width, from one another along the direction of the segment width (i.e. along the second longitudinal direction).

According to a further embodiment, the layer comprises a plurality of spacers, wherein the layer comprises a second gap at least between two adjacent spacers, and wherein the first panel comprises at least one first opening which at least partially overlaps with the second gap.

In particular, the spacers of the layer are spaced apart, the layer comprising second gaps between adjacent spacers, and the at least one first opening of the first panel at least partially overlapping one of the second gaps.

Alternatively, the layer can also be applied without second gaps, i.e. in particular with spacers close to each other.

According to a further embodiment, the first panel comprises a plurality of first openings, wherein each of the first openings overlaps at least partially with a respective second gap.

According to a further embodiment, the first panel comprises a plurality of first openings, each of the first openings overlapping at least partially with a respective first gap of a respective spacer or with a respective second gap of the layer.

According to a further embodiment, the adjacent spacers have a second distance of at least half a segment width, in particular at least one segment width, from one another transversely to the first longitudinal direction.

According to a further embodiment, the second panel comprises at least one second opening which at least partially overlaps with one of the first gaps and/or a respective second gap.

Such an at least one second opening is arranged on the opposite side (i.e. the upper side) of the pallet to the additional components of the pallet, e.g. feet. In particular, by means of such openings, it is advantageously possible to stack several pallets in a stable and space-saving manner by inserting the feet of another pallet according to the invention into the second openings.

In particular, the at least one second opening of the second panel respectively has an extension along the first longitudinal direction (i.e. along the direction of the pallet width) and an extension transverse to the first longitudinal direction in the plane of the first and second panels (i.e. in the direction of the pallet depth).

According to an embodiment, the at least one second opening has a rectangular shape.

According to a further embodiment, the pallet comprises at least one foot, each foot comprising two supporting elements and a joining element, the at least one foot comprising second mitres at which the supporting elements are mechanically connected to the joining element.

In particular, the supporting elements and the joining element are formed from panels or boards, the joining element being connected to the supporting elements at two opposite edges, so that an open cross-sectional profile of the foot is obtained.

The joining element of the at least one foot forms the bearing surface on the floor when the at least one foot is connected to the base of the pallet and the pallet stands on the at least one foot. The supporting elements particularly serve to connect the at least one foot to the pallet.

Such an arrangement, in particular the open construction of the foot, has the advantage that pallets equipped with such feet are easily stackable, the feet of a first pallet being insertable into the second openings of the second panel of a second pallet when the first pallet is stacked on the second pallet.

It is advantageously possible to store a pallet according to the invention on such feet. In addition, with appropriate distances between the feet, the pallet according to the invention can be used as a four-way pallet and, in particular, picked up using a forklift truck. The first gaps and/or second gaps of the layer and the overlapping first openings of the first panel allow the feet to be easily connected to the pallet without additional fasteners or attachments.

According to another embodiment, the profile of at least one foot formed between the supporting elements and the joining element has a trapezoidal segment shaped cross-section.

According to another embodiment, the supporting elements and the joining element each have a rectangular base. This makes it particularly easy to cut the individual feet from a larger blank.

According to a further embodiment, the supporting elements form second internal angles ($\beta$) with the joining element, which are the same size as the first internal angles ($\alpha$) between the lateral elements and the cover element of the tube segments.

According to another embodiment, the supporting elements form second internal angles ($\beta$) of 95° to 120°, particularly 100° to 110°, with the joining element. In particular, both supporting elements form the same second internal angle with the joining element.

This has the advantage that the tube segments and at least one foot can be manufactured using the same machines, so that production costs can be saved. In particular, the tube segments and at least one foot are manufactured from a panel or board by introducing mitres, folding the mitres and mechanical joining (e.g. gluing). Therein, the tube segments have a smaller extension in the second longitudinal direction than the at least one foot made from the same panel or board. In particular, the cover element has a smaller extension along the segment width than the largest extension of the joining element of the foot in the cross-section of the foot.

According to a further embodiment, the at least one foot is arranged at least partially in one of the first gaps or in a respective second gap.

The first and/or second gaps can be easily filled with appropriately dimensioned feet and connected to the pallet.

According to a further embodiment, the at least one foot is made of a wood-based material.

According to a further embodiment, the second internal angles between the supporting elements and the joining element of the at least one foot of the pallet are the same size as the first internal angles between the lateral elements and the cover element of the tube segments of the at least one spacer of the pallet.

According to a further embodiment, the supporting elements are foldable against the joining element so that an internal angle between the plane of extension of the respective supporting element and the joining element can be varied, so that in particular when the internal angle is reduced in a certain angular range, a mechanical stress arises between the respective supporting element and the joining element. This is possible, for example, with an HDF board material by the fact that the supporting elements and the joining element are connected to each other at mitres designed accordingly.

If, on insertion of the at least one foot through the at least one first opening, the foot is designed ed in such a way that the supporting elements are foldable around the joining element and the at least one foot is inserted through a respective second opening into the first gap or second gap, the foot opens after passing through the second opening by increasing the said internal angle and the supporting elements shift in the direction of the pallet depth or pallet width. Alternatively, the foot can be inserted into the first or second gap by a first opening of the first panel.

In particular, when the at least one foot and the first and/or second gaps are correspondingly designed, in the state in which the supporting elements are inserted into the respective first or second gaps, there is a mechanical stress through which the supporting elements exert a force on the second panel and the adjacent tube segments which advantageously promotes a fixed mechanical connection of the at least one foot to the pallet.

According to a further embodiment, the first gaps and/or the at least one second gap have an extension of at least 50 mm along the first longitudinal direction (i.e. along the pallet width) and an extension of at least 30 mm transverse to the first longitudinal direction along the plane of the first and second panels (i.e. along the pallet depth).

In the event that the extension of the first gaps and/or the at least one second gap along the first longitudinal direction and/or transversely to the first longitudinal direction is not constant, the term extension here means the minimum extension.

According to a further embodiment, the tube segments form a cavity with the first strip, in particular within the layer, the first panel comprising at least one first opening which overlaps at least partially with one of the cavities. Therein, additional components, in particular feet of the pallet, can be introduced into the correspondingly dimensioned cavities. In particular, certain feet of the pallet can be introduced into a respective cavity, and other feet of the pallet can be introduced into a respective first gap. Furthermore, certain feet of the pallet can be particularly placed in a respective cavity, and further feet of the pallet can be placed in a respective second gap. There is also provision for an embodiment in which at least one foot is inserted into a respective cavity, in which at least one further foot is inserted into a respective first gap and in which at least one further foot is inserted into a respective second gap.

According to a further embodiment, the second panel comprises at least one second opening which at least partially overlaps with one of the cavities.

According to a further embodiment, the cavities have an extension of at least 50 mm along the first longitudinal direction, the cavities having an extension of at least 30 mm transverse to the first longitudinal direction along the plane of the first and second panels.

A second aspect of the invention concerns a spacer, in particular for manufacturing a pallet according to the first aspect of the invention, comprising a first strip and a plurality of tube segments, the tube segments each comprising two cut ends delimiting the respective tube segment along a circumferential direction of the respective tube segment, and each comprising two cut surfaces, which delimit the respective tube segment along a second longitudinal direction of the respective tube segment, and wherein the tube segments of the spacer each comprise two lateral elements and a cover element mechanically connected to the lateral elements, wherein the lateral elements form first internal angles ($\alpha$) of 95° to 120°, in particular 100° to 110°, with the cover element.

According to a further embodiment, the tube segments of the spacer comprise first mitres on which the lateral elements are mechanically connected to the cover element.

According to a further embodiment, the tube segments have a trapezoidal segment shaped cross-section.

According to another embodiment, the tube segments of at least one spacer are mechanically connected to a first strip side of the first strip.

According to a further embodiment, the at least one spacer comprises a second strip which is mechanically connected to the walls of the tube segments of the respective spacer.

According to a further embodiment, the tube segments of the at least one spacer are spaced apart, wherein respective first gaps are formed between adjacent tube segments.

In accordance with a further embodiment, the tube segments have a segment width extending along the connecting line between the cut ends, the adjacent tube segments of the at least one spacer having a first distance of at least half a segment width, in particular at least one segment width, from one another along the direction of the segment width.

A third aspect of the invention concerns an intermediate product, in particular for the manufacture of a spacer according to the second aspect of the invention, comprising at least a first cover layer and a plurality of tube segments, wherein the tube segments each comprise two cut ends which delimit the respective tube segment along a circumferential direction of the respective tube segment, and each have two cut surfaces which delimit the respective tube segment along a second longitudinal direction of the respective tube segment, and wherein the tube segments are mechanically connected to the first cover layer by means of their cut ends, and wherein the tube segments each have a segment depth extending along a second longitudinal direction of extension of the respective tube segment and a segment width extending along the connecting line between the cut ends, and wherein the segment depth corresponds to at least twice the segment width, and wherein the tube segments of the intermediate product each comprise two lateral elements and a cover element mechanically connected to the lateral elements, wherein the lateral elements form first internal angles ($\alpha$) of 95° to 120°, in particular 100° to 110°, with the cover element.

According to a further embodiment, the tube segments of the intermediate product comprise first mitres on which the lateral elements are mechanically connected to the cover element.

According to a further embodiment, the tube segments have a trapezoidal segment shaped cross-section.

According to another embodiment, the tube segments of the intermediate product are mechanically connected to a first side of the first cover layer.

According to another embodiment, the intermediate product comprises a second cover layer which is mechanically connected to the walls of the tube segments of the intermediate product.

According to a further embodiment, adjacent tube segments of the intermediate product are spaced apart, wherein gaps are formed between adjacent tube segments.

According to a further embodiment, the tube segments have a segment width running along the connecting line between the cut ends, wherein the adjacent tube segments of the intermediate product have a first distance of at least half a segment width, in particular at least one segment width, from one another along the direction of the segment width.

According to an embodiment, the adjacent tube segments have a third distance along the direction of the segment width of at least half a segment width, in particular at least one segment width.

According to an embodiment, the intermediate product comprises a second cover layer running parallel to the first cover layer, which is mechanically connected to the walls of the tube segments.

A fourth aspect of the invention concerns a method of manufacturing a pallet, in particular according to the first aspect of the invention, the method comprising at least the following steps:

- providing an intermediate product according to the third aspect of the invention,
- producing at least one spacer, particularly according to the second aspect of the invention, by dividing the intermediate product transversely to the second longitudinal direction of the tube segments of the intermediate product,
- forming a layer by mechanically connecting the at least one spacer to a first panel, wherein a cut surface of each of the tube segments of the at least one spacer is mechanically connected to the first panel,
- mechanically connecting the at least one spacer to a second panel, wherein the other cut surface of the tube segments of the at least one spacer is connected to the second panel.

According to an embodiment of the method, at least one second gap is formed between adjacent spacers of the layer.

According to an embodiment of the method, the layer is formed by a plurality of spacers, wherein adjacent spacers of the layer are spaced apart, and wherein second gaps are formed between each of the adjacent tube segments.

According to a further embodiment, the adjacent spacers are arranged at a third distance of at least half a segment width, in particular at least one segment width, from each other.

According to an embodiment of the method, at least one opening of the first panel is at least partially coincided with a corresponding first gap between the adjacent tube segments of the corresponding spacer or with a corresponding second gap between the corresponding adjacent spacers of the layer.

According to a further embodiment of the method, after mechanically connecting the at least one spacer to the first panel, at least one opening is produced in the first panel so that the at least one opening is at least partially coincided with a corresponding first gap between the tube segments of a corresponding spacer or with a corresponding second gap between the adjacent tube segments.

The at least one first opening and the at least one second opening can be produced in particular by sawing or milling out of the first or second panel, respectively.

Further details and advantages of the invention are explained by the following description of examples on the basis of figures.

Figure 1:
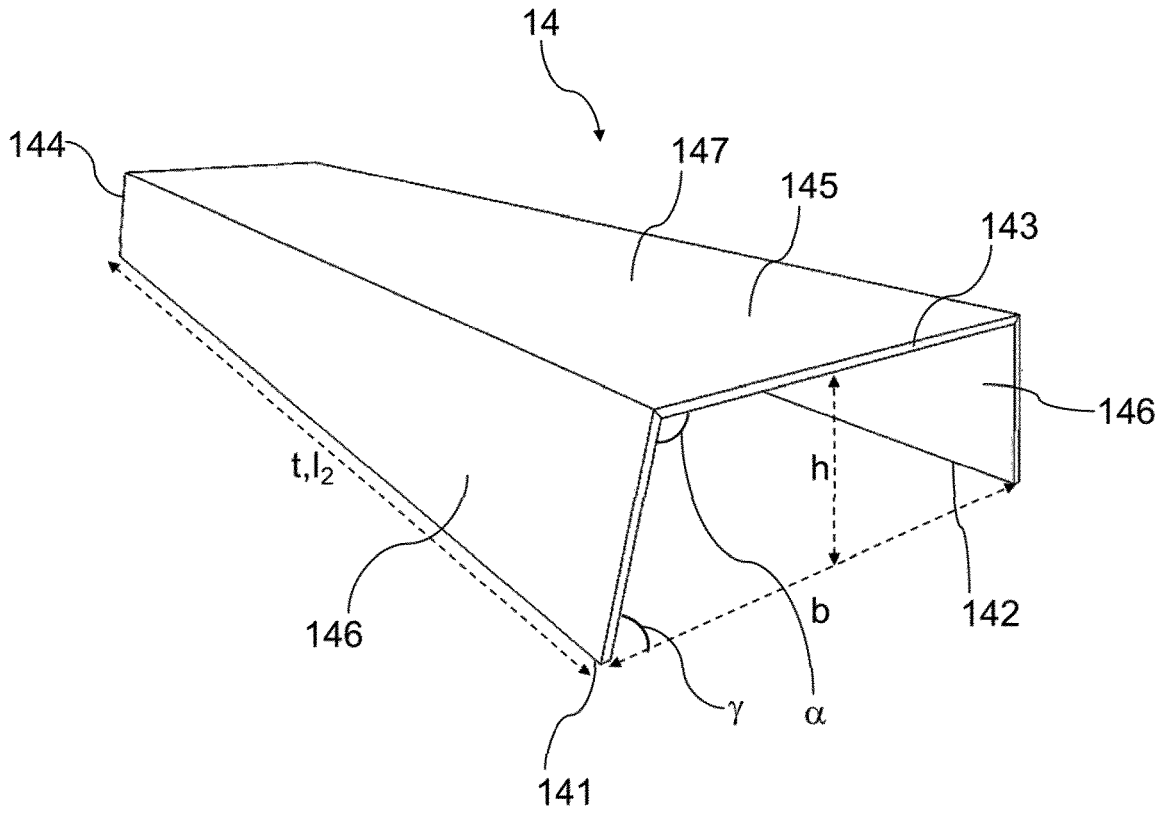
FIG. 1 shows a schematic representation of a tube segment.

FIG. 1 shows in detail a tube segment 14, which is extended along a longitudinal direction $l_2$ and comprises a wall 145 as well as two cut ends 141,142 delimiting the wall 145 in the circumferential direction of the tube segment 14. Furthermore, the tube segment 14 comprises two cut surfaces 143, 144, which delimit the tube segment 14 in the second longitudinal direction $l_2$.

The tube segment 14 has a segment depth tin the direction of the second longitudinal direction $l_2$, a segment width b corresponding to the maximum extension in the direction of a connecting line between the cut ends 141,142, and a segment height h corresponding to the maximum extension in the third spatial direction perpendicular to the segment width b and the segment depth t.

In the embodiment shown in FIG. 1, the tube segment 14 is formed by two lateral elements 146 extending essentially along the segment height h and a cover element 147 extending along the segment width b, the lateral elements 146 being connected by the cover element 147.

The lateral elements 146 are angled with respect to the segment width b, resulting in a trapezoidal segment shaped cross-section of the tube segment 14 transverse to the longitudinal direction l, wherein the lateral elements 146 comprise first internal angles $\alpha$ of 95° to 120° with the cover element 147.

As an alternative to the embodiment shown in FIG. 1, the tube segment 14 can also have a differently shaped cross-section.

Figure 2:
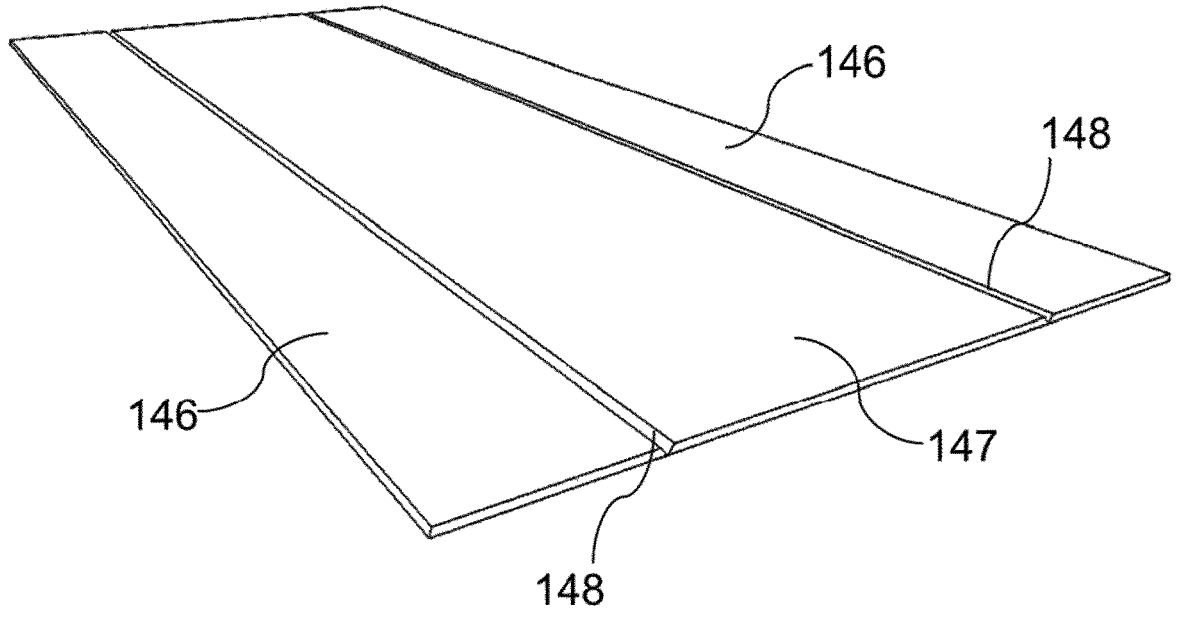
FIG. 2 shows a schematic representation of an intermediate product for creating a tube segment.

FIG. 2 shows an intermediate product from which the tube segment 14 shown in FIG. 1 can be formed by folding and mechanical joining, in particular gluing. The intermediate product consists of a panel, in particular a panel made of a wood-based material, the panel comprising first mitres 148, in particular V-shaped first mitres 148. The first mitres 148 extend between the parts of the panel which, in the folded and joined state, i.e. in the finished tube segment 14 (see FIG. 1), form the lateral elements 146 and the part of the panel which, in the folded and joined state, forms the cover element 147. These parts of the panel can be folded along the first mitres 148 to form a tube segment 14. The first mitres 148 can, for example, be applied with glue before folding, so that the lateral elements 146 can be firmly joined to the cover element 147.

Figure 3:
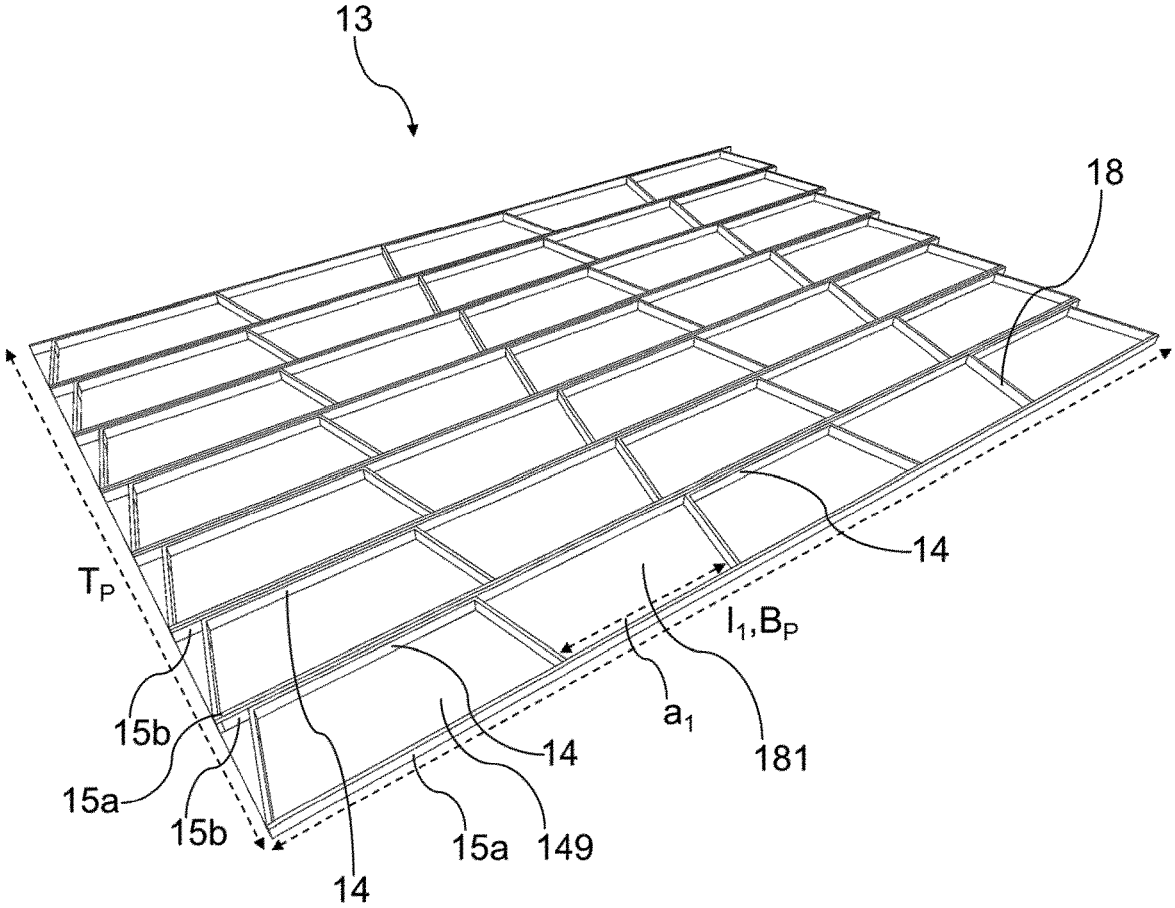
FIG. 3 shows a schematic representation of a layer of a pallet according to the invention.

FIG. 3 shows a layer 13 according to the invention of a pallet 1 according to the invention comprising a plurality of spacers 18 arranged in parallel along a first longitudinal direction 1, (along a pallet width $B_P$), the spacers 18 each being formed of a first strip 15*a*, a second strip 15*b* and a plurality of tube segments 14. The segment widths b of the tube segments 14 extend in the direction of the pallet width $B_P$ and the segment heights h of the tube segments 14 extend along a pallet depth $T_P$. The designations of segment width b, segment height h and segment depth t according to the illustration of the tube segment 14 can be found in FIG. 1.

The longitudinal directions $l_2$ of the tube segments 14 thus run transversely to a (imaginary) plane formed from the pallet width $B_P$ and the pallet depth $T_P$, which corresponds to the plane of the first panel 11 and the second panel 12 in the finished pallet 1. The adjacent tube segments 14 within a spacer 18 have first distances $a_1$ from each other in the direction of the first longitudinal direction $l_1$, so that first gaps 181 arise within the spacers 18.

The spacers 18 are arranged within the layer 13 in such a way that the corresponding strips 15*a*,15*b* of the adjacent spacers 18 lie against each other. The tube segments 14 form with the first strips 15*a* respective cavities 149.

Figure 4:
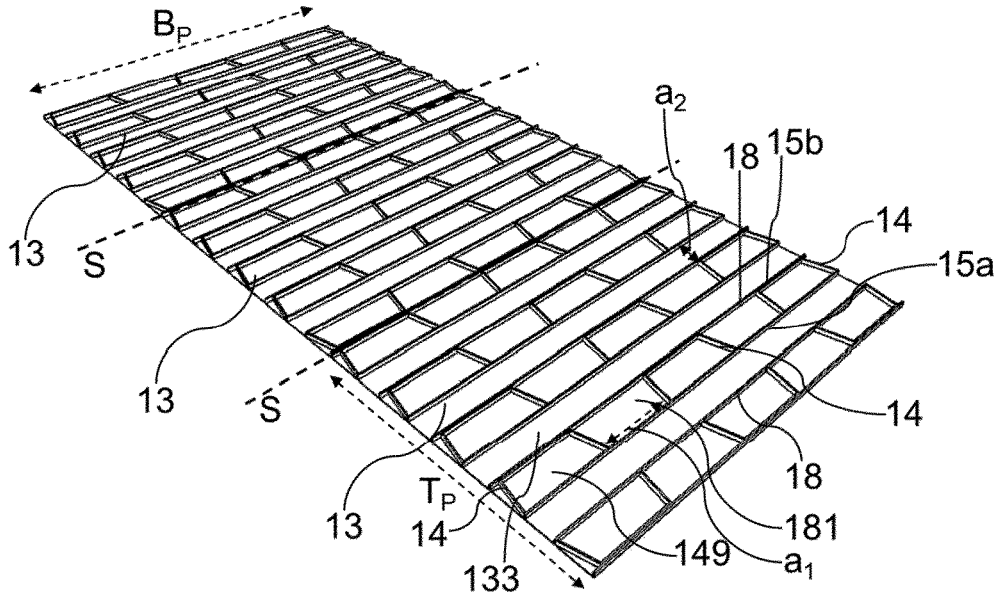
FIG. 4 shows a schematic representation of an intermediate product for producing a layer

FIG. 4 shows an intermediate product consisting of three layers 13 according to the invention, which are placed next to each other in the direction of their pallet depth $T_P$. The respective three layers 13 can be created by cuts along the cutting lines S. In this way, pallets in Euro pallet format, for example, can be created from a larger intermediate product.

In the embodiment shown in FIG. 4, the adjacent spacers 18 have second distances $a_2$ from each other in the direction of the pallet depth $T_P$, so that second gaps 133 are created.

Figure 5:
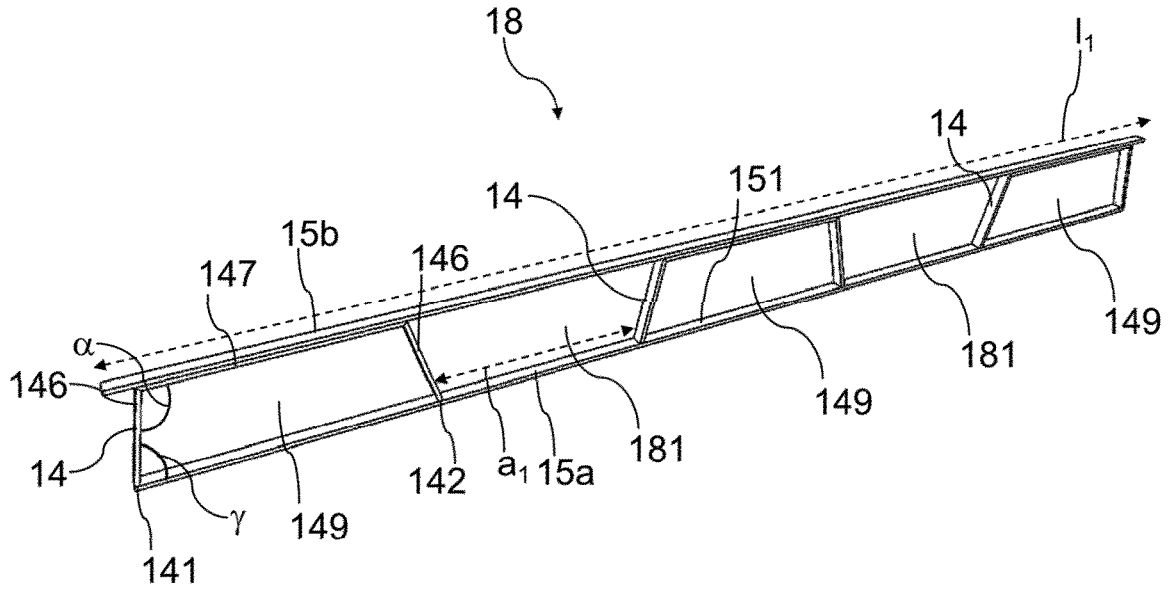
FIG. 5 shows a schematic representation of a spacer.

FIG. 5 shows a detailed view of a spacer 18 of the layer 13 of pallet 1 according to the invention shown in FIG. 3 or 4. The spacer 18 shown comprises a first strip 15*a* and a second strip 15*b* extending parallel to the first strip 15*a*, with tube segments 14 arranged between the first strip 15*a* and the second strip 15*b*. Therein, the cut ends 141,142 of the tube segments 14 are each connected to a first strip side 151 of the first strip 15*a* and the cover elements 147 of the tube segments 14 are connected to the second strip 15*b*. The respective adjacent tube segments 14 of the spacer have first distances $a_1$ from each other along the first longitudinal direction $l_1$, so that first gaps 181 are formed.

The lateral elements 146 of the tube segments 14 and the first strip 15*a* of the spacer form third internal angles $\gamma$ in the range of 60° to 85°, e.g. approx. 76°.

Figure 6:
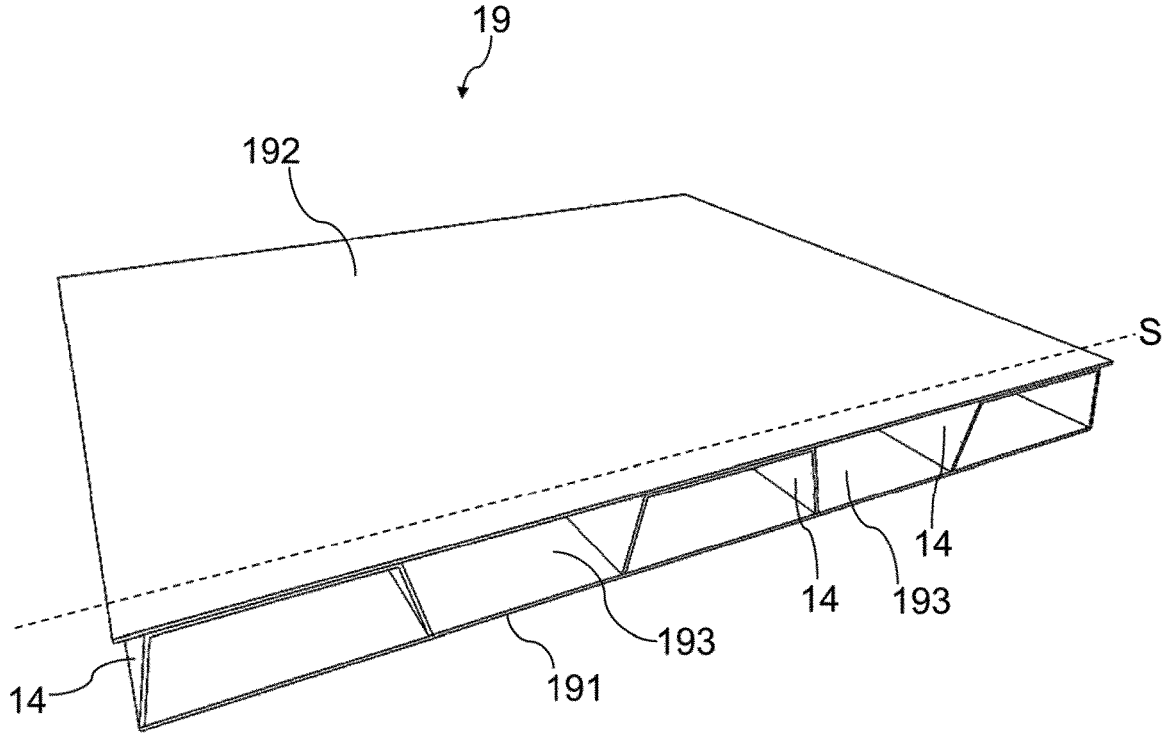
FIG. 6 shows a schematic representation of an intermediate product for creating spacers.

FIG. 6 shows an intermediate product 19 for the creation of spacers 18 (as shown in FIG. 5). The intermediate product 19 comprises a first cover layer 191 and a second cover layer 192, with the first and second cover layers 191,192 arranged parallel to each other. Furthermore, the intermediate product 19 comprises tube segments 14 arranged between the first and second cover layers 191,192, which are arranged parallel to each other along their second longitudinal directions $l_2$. The tube segments 14 have interspaces 193 between each other in the direction of the segment widths b. The tube segments 14 have interspaces 193 between each other in the direction of the segment widths b. The tube segments 14 used here have a significantly greater segment depth tin the direction of the second longitudinal direction $l_2$ than the tube segments of the spacer 18 shown in FIG. 5.

FIG. 6 also shows an imaginary cutting line S. If the intermediate product 19 is cut along the cutting line S transversely to the common longitudinal direction $l_2$ of the tube segments 14 of the intermediate product 19, a spacer 18 of the type shown in FIG. 5 can be produced. In this way a large number of spacers 18 can be produced from an intermediate product 19.

Figure 7:
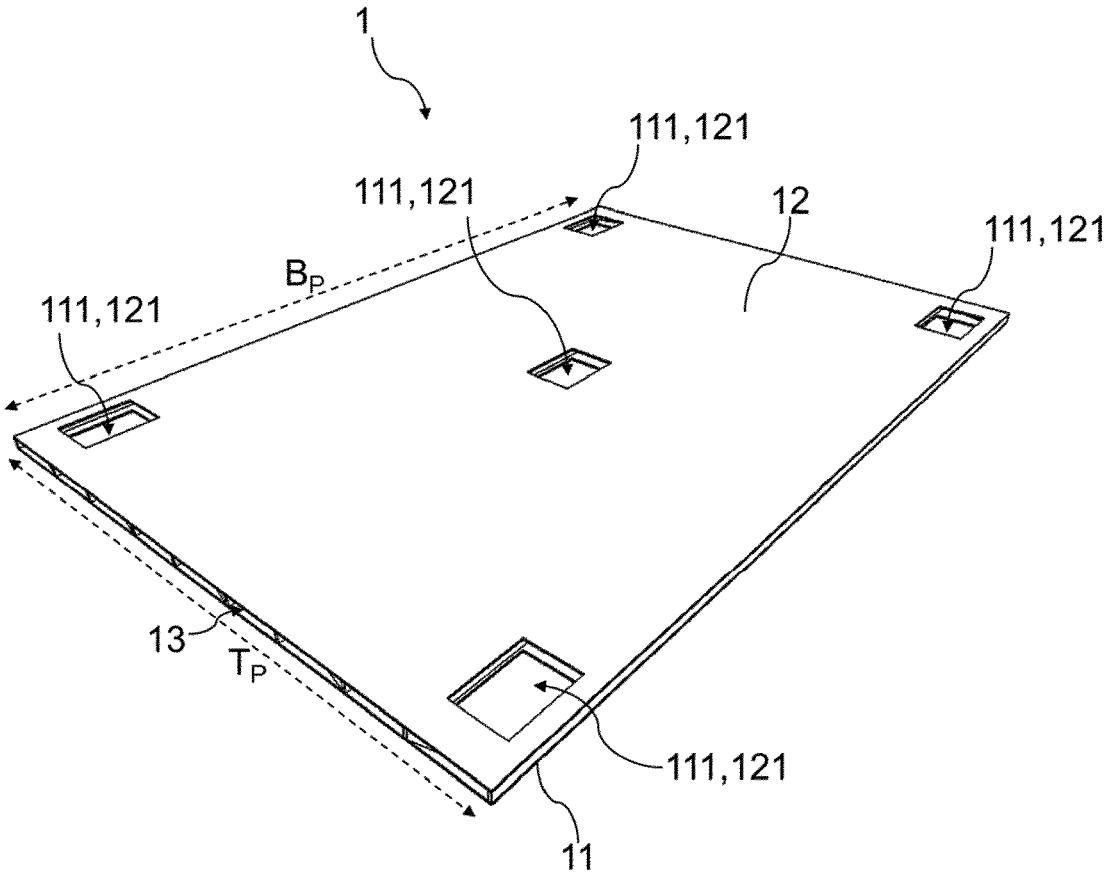
FIG. 7 shows a schematic representation of a pallet according to the invention.

FIG. 7 shows a pallet 1 according to the invention comprising parallel first and second panels 11,12 and a layer 13 arranged between the first panel 11 and the second panel 12. The layer 13 is similar to the layer 13 shown in FIG. 3 or FIG. 4. The first panel 11 comprises first openings 111, wherein the second panel 12 comprises second openings 121. The first openings 111 and the second openings 121 are coincided with respective first gaps 181 and/or second gaps 133 of the layer 13, so that continuous openings of the pallet 1 result transversely to the plane formed by the pallet width $B_P$ and the pallet depth $T_P$. It is advantageous to place feet 16 (see FIGS. 8-10) in these continuous openings. If the feet 16 are designed accordingly, the pallet 1 according to the invention can be designed as a stacking pallet by inserting the feet 16 of an upper pallet 1 into the second openings 121 of the second panel 12 of a lower pallet 1.

Figure 8:
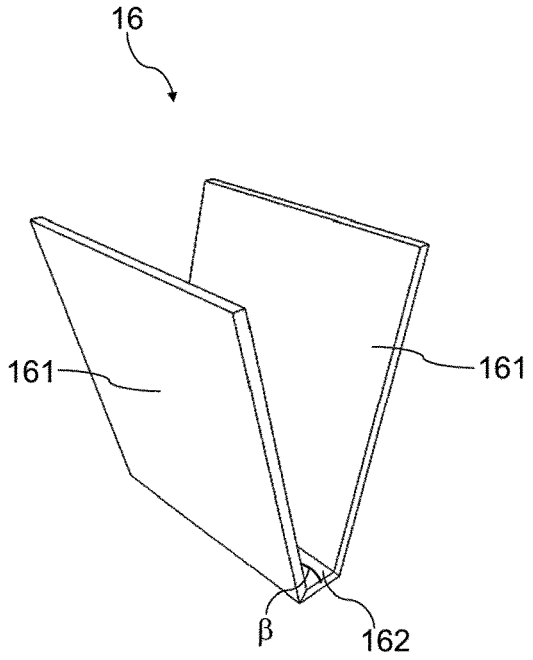
FIG. 8 shows a schematic representation of a foot of a pallet according to the invention.

FIG. 8 shows a perspective view of a foot 16 for a pallet 1 according to the invention in a folded form. The foot 16 comprises two supporting elements 161 and a joining element 162, which mechanically connects the supporting elements 161, wherein the supporting elements 161 form second internal angles β with the joining element 162, particularly in the range from 95° to 120°.

Figure 9:
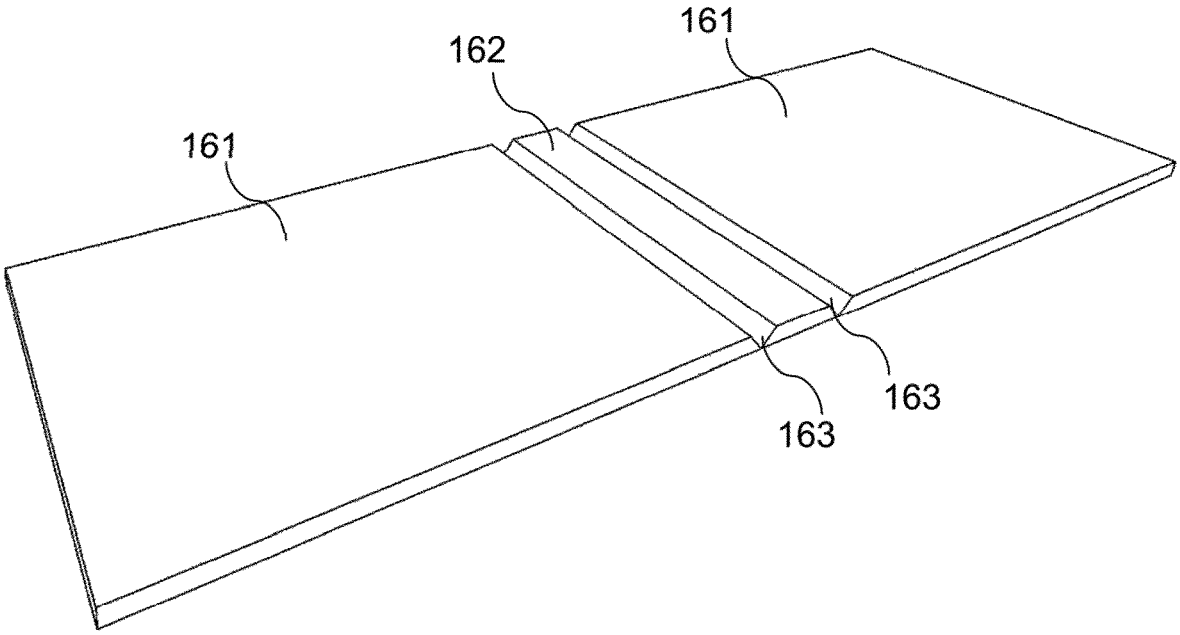
FIG. 9 shows a schematic representation of an intermediate product for creating a foot.

FIG. 9 shows foot 16 in an unfolded form. In the embodiment shown here, the foot 16 is formed from panels of a wood-based material, wherein the supporting elements 161 and the joining element 162 can be formed from a single panel which comprises sawn or milled second mitres 163, as shown in FIG. 9, in particular V-shaped mitres 163, between the supporting elements 161 and the joining element 162. The supporting elements 161 are rectangular in shape as shown here.

If the foot 16 is folded as shown in FIG. 8, a preload of the foot 16 can be produced by applying a force, so that particularly the foot 16 can be inserted through the at least one second opening 121 of the second panel 12 into the first gap 181 or second gap 133 under the preload. When the preload is released, the foot 16 opens at least partially, so that the supporting elements 161 form an at least partially positive connection with the inside of the second panel 12 or with the tube segments 14 of the layer 13.

Alternatively, the foot 16 can also be inserted into the respective first gap 181 or second gap 133 through a respective first opening 111 (i.e. from the underside of pallet 1). For example, a preload can be applied so that the distance between the supporting elements 161 is sufficiently reduced (and the second internal angles β are also reduced) so that the foot 16 fits through the respective first opening 111. By releasing the preload the foot 16 opens, so that particularly the foot 16 is fixed in the first gap 181 or second gap 133 and does not slip out of the first opening 111.

Figure 10:
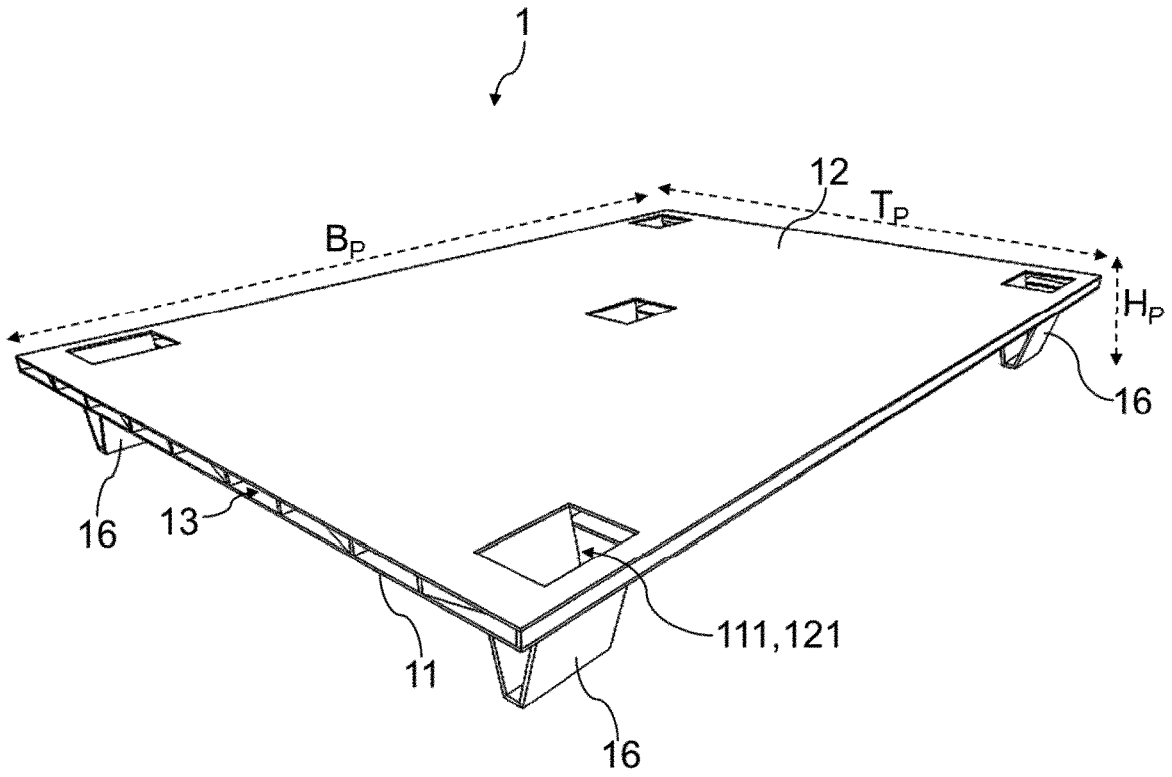
FIG. 10 shows a schematic representation of a pallet according to the invention with feet.

FIG. 10 shows a pallet 1 according to the invention in a embodiment with feet 16 in a perspective view from the top of pallet 1. Pallet 1 comprises a layer 13 arranged between a first panel 11 and a second panel 12. The layer 13 is structured in the same way as the layer 13 shown in FIG. 3. The segment depths t of the tube segments 14 of layer 13 extend in the direction of a pallet height $H_P$, which extends perpendicular to the plane of the first panel 11 and the second panel 12. The Layer 13 comprises first gaps 181 and/or second gaps 133 (hidden here), which overlap with second openings 121 of the second panel 12. Therein, the second openings 121 are narrower in the direction of pallet depth $T_P$ than the extension of the corresponding first gaps 181 and/or second gaps 133 in the direction of pallet depth $T_P$. Thus the supporting elements 161 of the feet 16 (see FIG. 8) are arranged in corresponding spaces between the second panel 12 and the tube segments 14 adjacent to the corresponding first or second gap 181, 133. In the first or second gaps 181,133, which are accessible upwards by means of the second openings 121, the feet 16 of a further pallet 1 can be inserted, for example, when stacking several pallets 1 according to the invention, which allows space-saving stacking.

LIST OF REFERENCE NUMERALS

| | |
|---|---|
| 1 | Pallet |
| 11 | First panel |
| 111 | First opening |
| 12 | Second panel |
| 121 | Second opening |
| 13 | Layer |
| 133 | Second gap |
| 14 | Tube segment |
| 141, 142 | Cut ends |
| 143, 144 | Cut surfaces |
| 145 | wall |
| 146 | Lateral element |
| 147 | Cover element |
| 148 | First mitre |
| 149 | Cavity |
| 15a | First strip |
| 15b | Second strip |
| 151 | First strip side |
| 16 | Foot |
| 161 | Supporting element |
| 162 | Joining element |
| 163 | Second mitre |
| 18 | Spacer |
| 181 | First gap |
| 19 | Intermediate product |
| 191 | First cover layer |
| 192 | Second cover layer |
| 193 | Interspace |
| $l_1$ | First longitudinal direction |
| $l_2$ | Second longitudinal direction |
| $a_1$ | First distance |
| $a_2$ | Second distance |
| b | Segment width |
| t | Segment depth |
| h | Segment height |
| $B_P$ | Pallet width |
| $T_P$ | Pallet depth |
| $H_P$ | Pallet height |
| S | Cutting line |
| α | First internal angle |
| β | Second internal angle |
| γ | Third internal angle |

The invention claimed is:

1. Pallet (1) comprising at least the following components:

a first panel (11) and a second panel (12) extending parallel to the first panel (11), a layer (13) arranged between the first panel (11) and the second panel (12) and comprising at least one spacer (18) extending along a first longitudinal direction ($l_1$) and each comprising a first strip (15*a*) and a plurality of tube segments (14), wherein the tube segments (14)

each comprise two cut ends (141,142) which delimit the respective tube segment (14) along a circumferential direction of the respective tube segment (14), and each comprise two cut surfaces (143, 144) which delimit the respective tube segment (14) along a second longitudinal direction ($l_2$) of the respective tube segment (14), wherein the tube segments (14) are mechanically connected to the first strip (15*a*) by means of their cut ends (141, 142), and mechanically connected to the first panel (11) and the second panel (12) by means of their cut surfaces (143, 144), characterized in that the tube segments (14) of the at least one spacer (18) each comprise two lateral elements (146) and a cover element (147) mechanically connected to the lateral elements (146), wherein the lateral elements (146) form first internal angles ($\alpha$) of 95° to 120° with the cover element (147).

2. Pallet (1) according to claim 1, characterized in that the first internal angles ($\alpha$) are 100° to 110°.

3. Pallet (1) according to claim 1, characterized in that the tube segments (14) comprise first mitres (148) on which the lateral elements (146) are mechanically connected to the cover element (147).

4. Pallet (1) according to claim 1, characterized in that the tube segments (14) have a trapezoidal-segment-shaped cross-section.

5. Pallet (1), according to claim 1, characterized in that the tube segments (14) of the at least one spacer (18) are mechanically connected to a first strip side (151) of the first strip (15*a*).

6. Pallet (1) according to claim 1, characterized in that the at least one spacer (18) comprises a second strip (15*b*) mechanically connected to walls (145) of the tube segments (14) of the respective spacer (18).

7. Pallet (1) according to claim 1, characterized in that the tube segments (14) of the at least one spacer (18) are spaced apart, wherein the at least one spacer (18) respectively comprises first gaps (181) between adjacent tube segments (14), and wherein the first panel (11) comprises at least one first opening (111) at least partially overlapping one of the first gaps (181).

8. Pallet (1) according to claim 7, characterized in that the tube segments (14) have a segment width (B) running along the connecting line between the cut ends (141, 142), the adjacent tube segments (14) of the at least one spacer (18) having a first distance ($a_1$) of at least half a segment width (B) from one another along the direction of the segment width (B).

9. Pallet (1) according to claim 7, characterized in that the tube segments (14) have a segment width (B) running along the connecting line between the cut ends (141, 142), the adjacent tube segments (14) of the at least one spacer (18) having a first distance ($a_1$) of at least one segment width (b) from one another along the direction of the segment width (B).

10. Pallet (1) according to claim 1, characterized in that the layer (13) comprises a plurality of spacers (18), the layer (13) comprising a second gap (133) at least between two adjacent spacers (18), and the first panel (11) comprising at least one first opening (111), which at least partially overlaps with the second gap (133).

11. Pallet (1) according to claim 10, characterized in that the adjacent spacers (18) have a second distance ($a_2$) from one another transversely to the first longitudinal direction ($l_1$) of at least half a segment width (B).

12. Pallet (1) according to claim 10, characterized in that the layer (13) comprises a plurality of spacers (18), the layer (13) comprising second gaps (133) between respective adjacent spacers (18), and the at least one first opening (111) of the first panel (11) at least partially overlapping with one of the second gaps (133).

13. Pallet (1) according to claim 10, characterized in that the adjacent spacers (18) have a second distance ($a_2$) from one another transversely to the first longitudinal direction ($l_1$) of at least one segment width (B).

14. Pallet (1) according to claim 1, characterized in that the second panel (12) comprises at least one second opening (121) which at least partially overlaps with one of the first gaps (181) and a respective second gap (133).

15. Pallet (1) according to claim 1, characterized in that the pallet (1) comprises at least one foot (16) each comprising two supporting elements (161) and a joining element (162), the at least one foot (16) comprising second mitres (163) at which the supporting elements (161) are mechanically connected to the joining element (162).

16. Pallet (1) according to claim 15, characterized in that the at least one foot (16) has a trapezoidal-segment-shaped cross-section.

17. Pallet (1) according to claim 15, characterized in that the supporting elements (161) form with the joining element (162) second internal angles ($\beta$) which are of the same size as the first internal angles ($\alpha$) between the lateral elements (146) and the cover element (147) of the tube segments (14).

18. Pallet (1) according to claim 15, characterized in that the at least one foot (16) is arranged at least partially in one of the first gaps (181) or in a respective second gap (133).

19. Pallet (1) according to claim 1, characterized in that the second panel (12) comprises at least one second opening (121) which at least partially overlaps with one of the first gaps (181) or a respective second gap (133).

* * * * *